US007905566B2

(12) United States Patent
Umeda

(10) Patent No.: US 7,905,566 B2
(45) Date of Patent: Mar. 15, 2011

(54) LIQUID EJECTING DEVICE

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 815 days.

(21) Appl. No.: 11/903,933

(22) Filed: Sep. 25, 2007

(65) Prior Publication Data

US 2008/0079767 A1 Apr. 3, 2008

(30) Foreign Application Priority Data

Sep. 29, 2006 (JP) ..... 2006-268497

(51) Int. Cl.
*B41J 29/393* (2006.01)
*B41J 2/12* (2006.01)
*B41J 2/125* (2006.01)

(52) U.S. Cl. ..... 347/19; 347/78; 347/81

(58) Field of Classification Search ..... 347/19, 347/81; 73/1.57
See application file for complete search history.

(56) References Cited

U.S. PATENT DOCUMENTS 6,641,246 B2 11/2003 Endo et al.
6,736,480 B2 5/2004 Endo

FOREIGN PATENT DOCUMENTS

| | | | |
|---|---|---|---|
| JP | 09-024621 | * | 1/1997 |
| JP | 9024621 | | 1/1997 |
| JP | 11342624 | | 12/1999 |
| JP | 2002178501 | | 6/2002 |
| JP | 2003266670 | | 9/2003 |

* cited by examiner

*Primary Examiner* — Uyen-Chau N Le
*Assistant Examiner* — Kajli Prince
(74) *Attorney, Agent, or Firm* — Frommer Lawrence & Haug LLP

(57) ABSTRACT

A liquid ejecting device including an ejecting head having an ejecting nozzle through which the ejecting head ejects a liquid in the form of a liquid droplet, a liquid droplet receiving portion having an outlet that is open for forming a meniscus using the liquid droplet ejected from the ejecting head, and a meniscus determining unit for determining whether or not the meniscus is formed at the outlet.

10 Claims, 7 Drawing Sheets

LIQUID EJECTING DEVICE

This application claims priority from Japanese Patent Application No. 2006-268497 filed on Sep. 29, 2006, the entire subject matter of which is incorporated herein by reference.

BACKGROUND OF THE INVENTION

1. Field of the Invention

The present invention relates to a liquid ejecting device which ejects liquid as a liquid droplet. This invention is particularly effective when applied to an inkjet recording device (inkjet printer).

2. Description of Related Art

An inkjet recording device forms an image on a recording medium by ejecting a liquid (e.g., ink), in the form of liquid droplets, from an ejecting head (recording head) onto the recording medium (e.g., a sheet).

In such an inkjet recording device, if the liquid droplet is ejected irregularly from the ejecting head (nozzle) because the nozzle for ejecting the liquid droplet (ink) is clogged or the like, then a desired image is not formed on the recording medium. Accordingly, it is desirable to periodically check the ejecting head to detect an ejection failure. One example of how to periodically check the ejecting head to detect an ejection failure is to eject a liquid droplet from the ejection head into/onto an ejection failure detecting unit.

In an invention disclosed in Japanese Unexamined Patent Application Publication No. 9-24621, a pair of electrodes are provided in an ejection failure detecting unit, so that when a liquid droplet is ejected to the ejection failure detecting unit, the liquid droplet causes a short circuit between the pair of electrodes. In the invention disclosed in this publication, it is detected whether or not the liquid droplet is ejected irregularly from an ejecting head (ejection failure of the ejecting head), by determining whether or not electric current flows between the pair of electrodes.

Since liquid such as ink generally has a low conductivity, there is only a small difference between the value of a current flowing between the pair of electrodes when they are in the short-circuited state (i.e., the liquid droplet passes between the electrodes), and the value of a current flowing between the pair of electrodes when they are not in the short-circuited state (i.e., no liquid droplet passes between the electrodes).

Owing to this, it is difficult to accurately detect an ejection failure of the ejecting head with the invention disclosed in the above publication because the determination as to whether or not the electric current flows between the pair of electrodes is not reliable.

SUMMARY OF THE INVENTION

A liquid ejecting device including an ejecting head having an ejecting nozzle through which the ejecting head ejects a liquid in the form of a liquid droplet, a liquid droplet receiving portion having an outlet that is open for forming a meniscus using the liquid droplet ejected from the ejecting head, and a meniscus determining unit for determining whether or not the meniscus is formed at the outlet.

DETAILED DESCRIPTION OF EMBODIMENTS

Embodiments of the present invention are described below with reference to the drawings.

Figure 1:
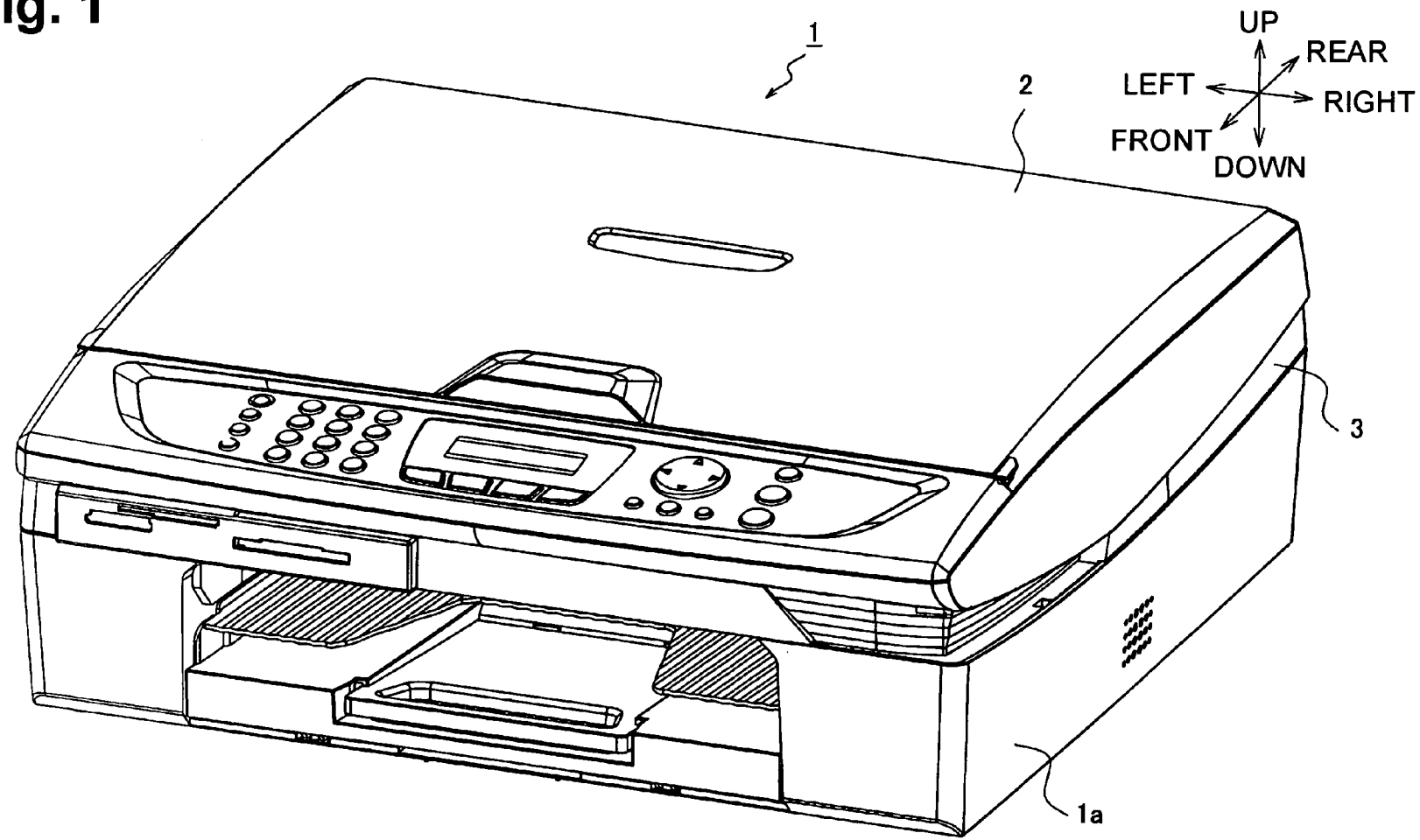
FIG. 1 is a perspective view showing the appearance of a multi-function device according to a first embodiment of the invention.

A liquid ejecting device according to a first embodiment of the present invention is applied to a multi-function device having a printer function, a scanner function, a copier function, and a facsimile function. FIG. 1 is a perspective view showing the appearance of a multi-function device 1.

As shown in FIG. 1, the multi-function device 1 has a scanner unit 2 at an upper portion for reading an image of an original, and a casing 1*a* at a lower portion. An inkjet recording device 3 (see FIG. 2) is provided at an upper portion inside the casing 1*a*. The inkjet recording device 3 forms (records) an image on a sheet of recording media 20.

Figure 2:
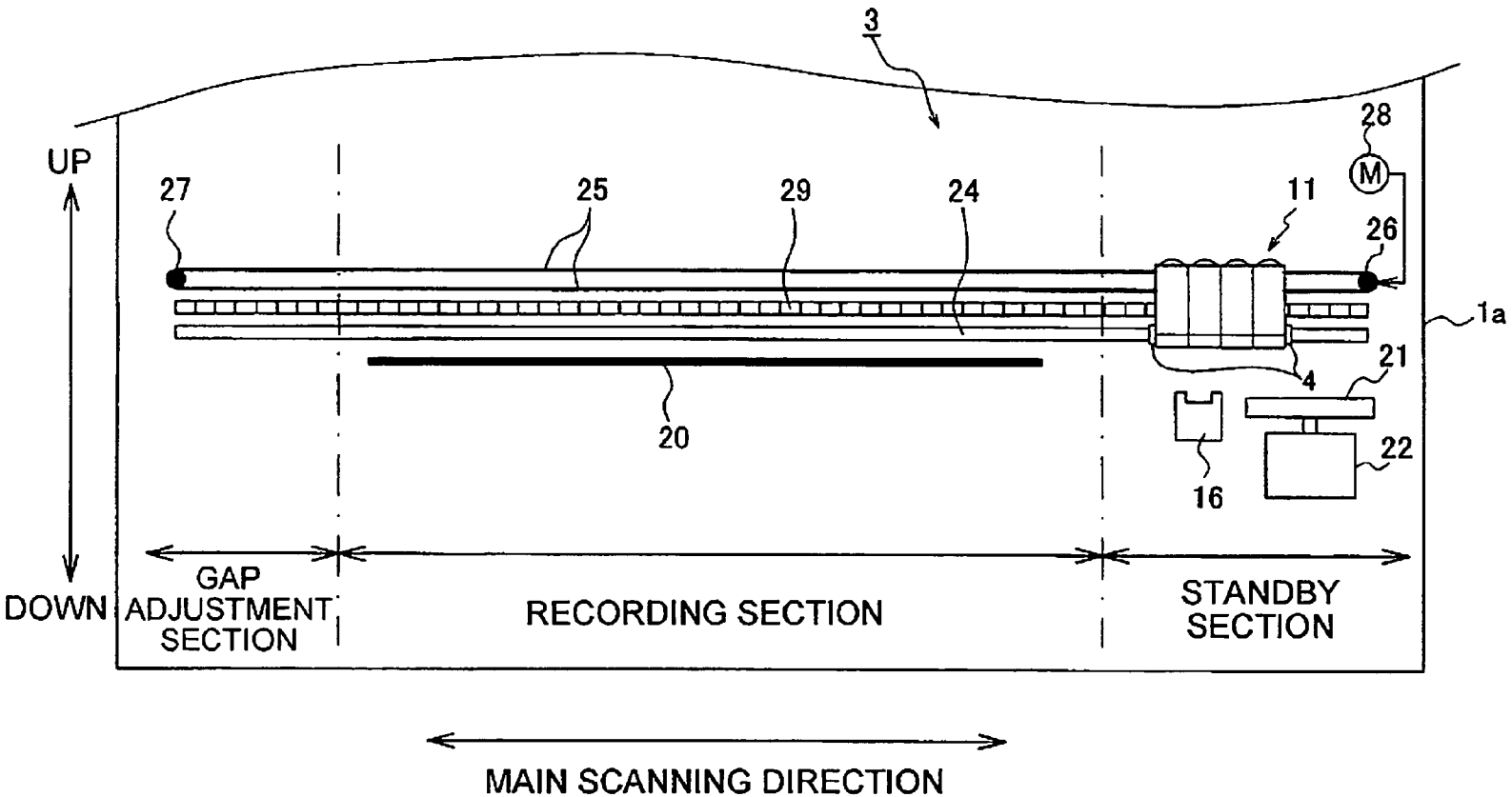
FIG. 2 is a schematic illustration showing an overall configuration of an inkjet recording device.
Figure 3:
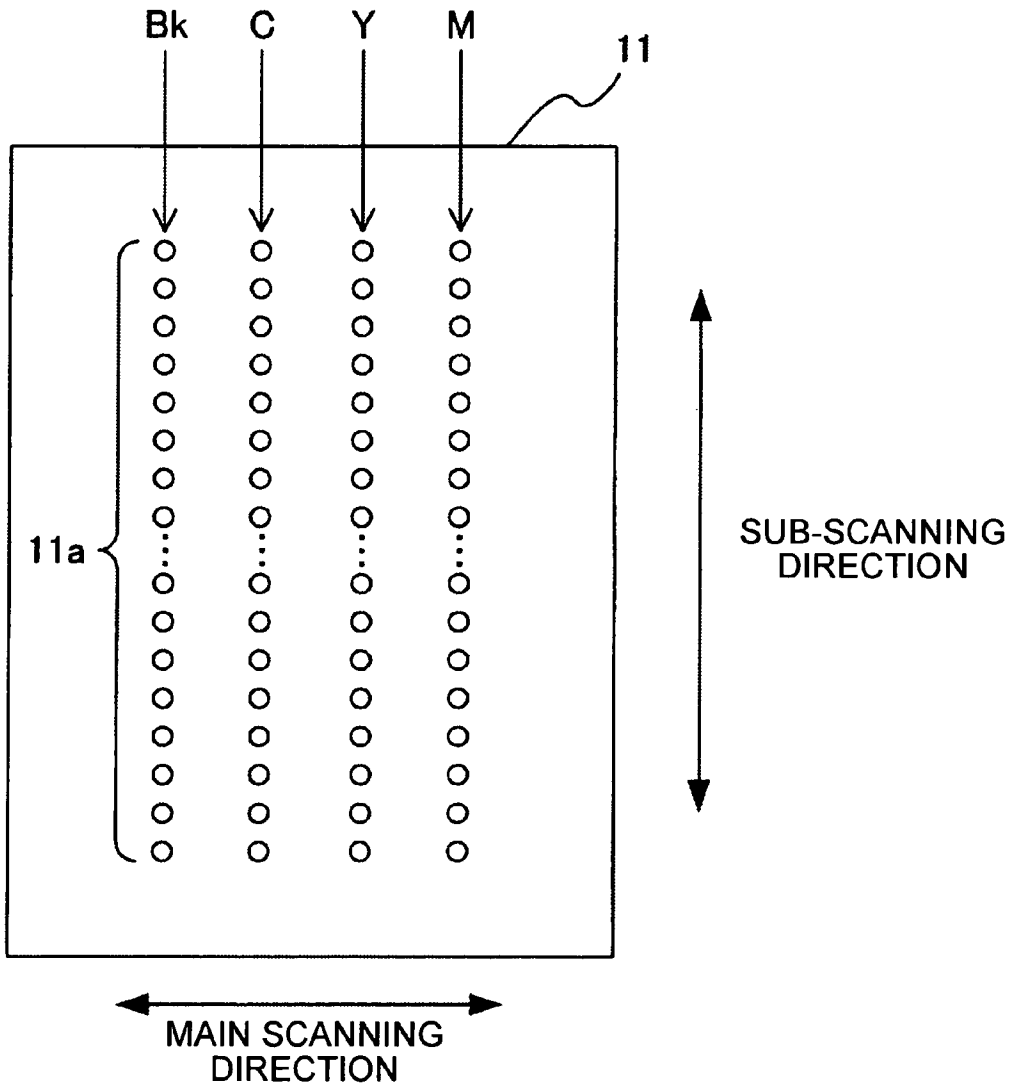
FIG. 3 is an enlarged view showing a lower surface of a recording head.

FIG. 2 is a schematic illustration, as seen from the front of the multi-function device 1 showing an overall configuration of the inkjet recording device 3. FIG. 3 is an enlarged view showing a lower surface of a recording head 11.

As shown in FIG. 2, the inkjet recording device 3 includes the recording head 11 having ink nozzles 11*a* (see FIG. 3) for ejecting ink droplets, as well as an ink tank (not shown) for supplying ink to the recording head 11.

The recording head 11 is mounted on a carriage 4. As shown in FIG. 3, a plurality of ink nozzles 11*a* (150 nozzles in this embodiment) are arrayed in a row along a sub-scanning direction (sheet conveying direction), thereby defining a nozzle array. The sub-scanning direction is a direction going into and coming out of the drawing sheet of FIG. 2. A plurality of the nozzle arrays (in this embodiment, four arrays) are provided along a main scanning direction (left and right direction in the drawing).

The ink nozzles 11*a* of the nozzle array located at the left side of the recording head 11 in FIG. 3 eject black (Bk) ink. The ink nozzles 11*a* of the remaining three nozzle arrays respectively eject cyan (C) ink, yellow (Y) ink, and magenta (M) ink, as indicated in FIG. 3.

The inkjet recording device 3 records and forms an image on a sheet 20 by ejecting ink of the various colors on the sheet 20 while the recording head 11 moves back and forth in the main scanning direction.

As shown in FIG. 2, a guide bar 24 is a guide member extending in the main scanning direction of the carriage 4 (recording head 11) so as to guide the movement of the carriage 4. The carriage 4 is coupled to an endless belt 25.

The endless belt 25 extends between a pulley 26 (right side of FIG. 2) and an idle pulley 27 (left side of FIG. 2). The pulley 26 is rotated by a carriage motor (CR motor) 28.

When the carriage motor 28 rotates the endless belt 25, the carriage 4 (i.e., the recording head 11) moves parallel to the left and right direction in the drawing (main scanning direction).

A timing slit 29, which extends parallel to a longitudinal direction of the guide bar 24, is disposed in the vicinity of the guide bar 24. The timing slit 29 has linear apertures (slits) having a common predetermined width. The linear apertures (slits) are arranged with a predetermined pitch in a longitudinal direction of the timing slit 29.

The carriage 4 has a detector (not shown) including a photo interrupter in which a light-emitting element and a light-receiving element face each other with the timing slit 29 interposed therebetween. The detector and the timing slit 29 constitute a linear encoder (carriage feed encoder) 30 (see FIG. 5) that detects a moving distance (position) of the carriage 4 (recording head 11).

As shown in FIG. 2, the area where the carriage 4 moves back and forth along (moves parallel to) the guide bar 24 is divided into three sections: a recording section where recording is performed on a sheet 20; a standby section where no recording is performed; and a gap adjustment section.

The standby section is provided in the vicinity of an end of the guide bar 24 near the pulley 26. The carriage 4 stands by in the standby section when neither recording nor maintenance is performed. At other times, the recording head 11 is checked in the standby section to see if there is an ink-droplet-ejection failure. In addition, a recovery operation is executed in the standby section to remove dried ink in the ink nozzle 11*a* (see FIG. 3) or a foreign substance trapped in the ink nozzle 11*a*. In this way, normal ink ejection can be performed.

The gap adjustment section is for the operation of a gap adjustment unit (not shown). The gap adjustment unit adjusts the size of a gap between a sheet 20 and the ink nozzles 11*a* (see FIG. 3) of the recording head 11, to an optimum value.

In the standby section, a cap 21 is disposed at a position facing the recording head 11 when the carriage 4 is stopped at a position for the recovery operation (right end position in FIG. 2). The cap 21 includes a cover member that covers one of the four arrays of ink nozzles 11*a* provided at the recording head 11. The cap 21 is driven by a cap driving unit 22.

The cap 21 and the cap driving unit 22 are arranged below the recording head 11 in the standby section. When the carriage 4 is stopped at the position for the recovery operation, the cap driving unit 22 moves the cap 21 upward so that the cap 21 contacts the lower surface of the recording head 11 to cover an array of ink nozzles 11*a*.

In contrast, when the carriage 4 (recording head 11) is moved during a recording operation, the cap driving unit 22 moves the cap 21 downward so as to uncover the ink nozzles 11*a*.

A waste ink tank 32 (see FIG. 4A) is connected to the cap 21, for collecting unnecessary ink using a suction pump 34 (see FIG. 4A) described below. A recovery operation is performed when the suction pump 34, which is connected to the cap 21 via a switching mechanism 36, is operated while the ink nozzles 11*a* are covered by the cap 21. The recovery operation is performed so as to remove dried ink or a foreign substance from the ink nozzle 11*a*. The suction pump 34 then sends the dried ink and foreign substance that were removed from the nozzle 11*a* to the waste ink tank 32.

In addition, an ejection failure detecting unit 16 is provided adjacent to the cap 21 in the main scanning direction of the carriage 4. The ejection failure detecting unit 16 detects any ink-droplet-ejection failure of the recording head 11.

FIG. 4 is an explanatory illustration showing a configuration of the ejection failure detecting unit 16.

Figure 4A:
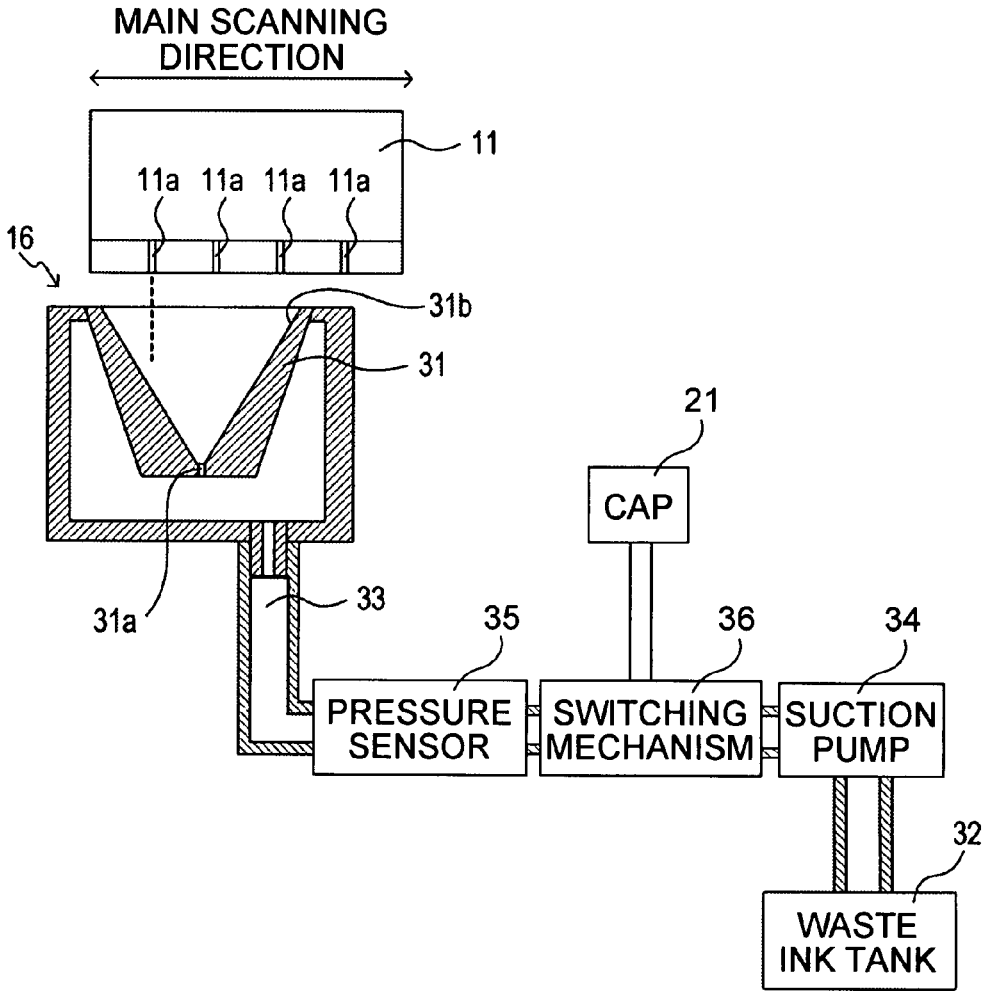
FIG. 4 is an explanatory illustration showing a configuration of an ejection failure detecting unit.

As shown in FIG. 4A, the ejection failure detecting unit 16 includes a plurality of ink droplet receiving portions 31 each having a funnel-like shape, a suction pump 34 for generating a negative pressure, and a pressure sensor 35.

The ink droplet receiving portions 31 are disposed in the standby section below the recording head 11 (see FIG. 2). The number of ink droplet receiving portions 31 corresponds to the number of ink nozzles 11*a* in each nozzle array. In this embodiment, there are 150 ink droplet receiving portions 31. Every ink droplet receiving portion 31 is treated with a water repellant finish.

Figure 4B:
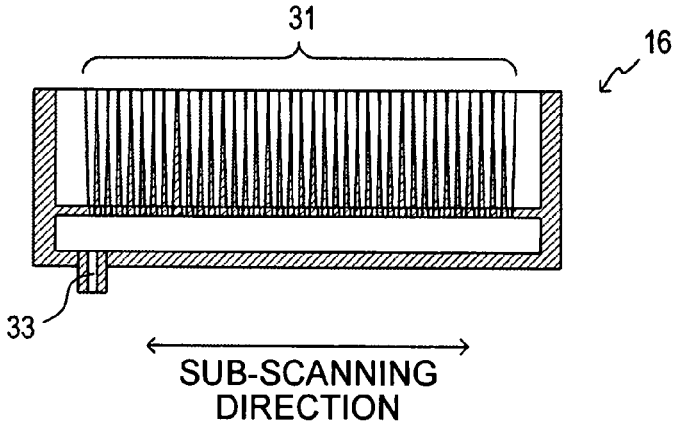

As shown in FIG. 4B, the ink droplet receiving portions 31 are separately formed and arranged along an array corresponding to the direction of the arrays of ink nozzles 11*a* (i.e., sub-scanning direction).

As shown in FIG. 4A, each of the ink droplet receiving portions 31 has a triangular cross section as seen in the sub-scanning direction. At the lower end of each ink droplet receiving portion 31, an outlet 31*a* is formed. Each outlet 31*a* is open so that a meniscus can be formed using by an ink droplet that is ejected (not for the purpose of printing) from the recording head 11.

An opening 31*b* is formed at an upper side of the ink droplet receiving portion 31, and has an ellipsoidal shape. The major axis direction thereof is substantially parallel to the main scanning direction. Each of the ink droplet receiving portions 31 is formed in a funnel-like shape. The major and minor axes thereof are continuously and smoothly reduced in length from the upper opening 31*b* toward the outlet 31*a* while maintaining the ellipsoidal opening shape of the ink droplet receiving portion 31.

The diameter of the outlet 31*a* of this embodiment is 0.05 to 0.1 mm. Also, the gap between the adjacent outlets 31*a* are substantially equivalent to the gap between the adjacent ink nozzles 11*a* in each of the nozzle arrays.

As shown in FIG. 4A, a common ink collecting path 33 is coupled to every outlet 31*a*. The ink collecting path 33 connects the ink droplet receiving portions 31 to the waste ink tank 32. The ink collecting path 33 runs through the suction pump 34, the switching mechanism 36, and the pressure sensor 35. The suction pump 34 generates a negative pressure in the ink collecting path 33. The pressure sensor 35 detects the pressure in the ink collecting path 33 between the ink droplet receiving portions 31 and the suction pump 34.

Figure 5:
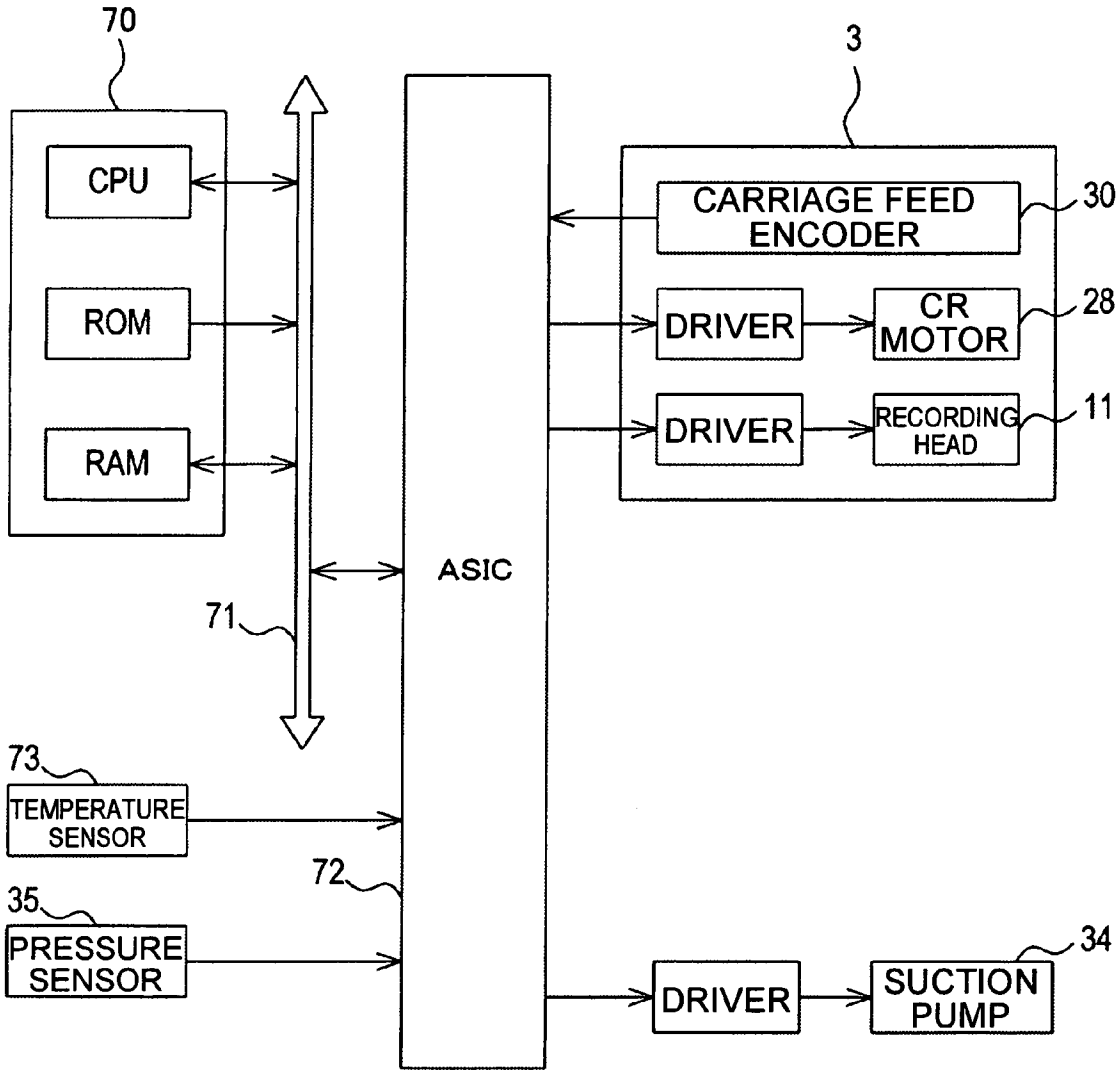
FIG. 5 is a block diagram showing an electric configuration of the multi-function device.

FIG. 5 is a block diagram showing an electric configuration of a control device of the multi-function device 1.

As shown in FIG. 5, the control device is a microcomputer having a central processor 70 provided with a CPU, ROM, and RAM. The central processor 70 can transmit data to, and receive data from, various sensors, (e.g., the pressure sensor 35, a temperature sensor 73, and the inkjet recording device 3) through a bus 71 and an application specific integrated circuit ("ASIC") 72.

The ROM of the central processor 70 has a predetermined computer program stored therein. In accordance with the program stored in the ROM, and based on information provided by the various sensors, the CPU (1) controls rotation of the carriage motor 28, which moves the carriage 4 in a sliding manner, (2) controls ejection of the ink droplets from the ink nozzles 11*a* in the recording head 1, and (3) controls the suction pump 34.

Figure 6:
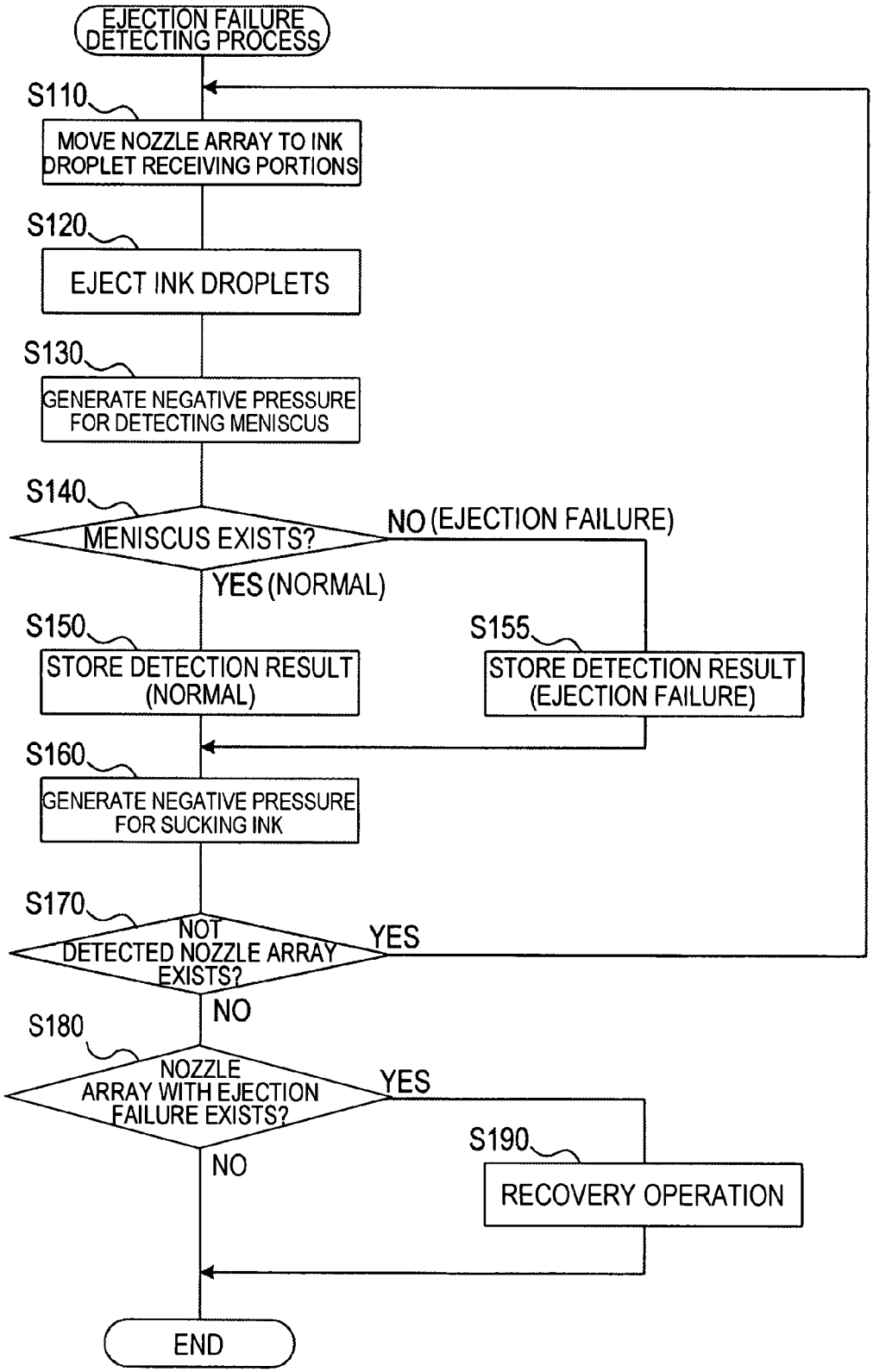
FIG. 6 is a flowchart showing an ejection failure detecting process which is executed by a control device of the multi-function device.

FIG. 6 is a flowchart showing process for detecting an ejection failure, which is executed by the control device of the multi-function device 1. This process (shown in the flowchart in FIG. 6) is executed before the recording operation is performed on a sheet 20. In particular, the process shown in FIG. 6 is performed before the ink droplets are ejected onto a sheet 20.

In the ejection failure detecting process shown in FIG. 6, each nozzle array is checked for ejection failure. In this embodiment, the Bk ink nozzle array, the C ink nozzle array and the M ink nozzle array are sequentially checked in that order.

When the process shown in FIG. 6 is started, the carriage 4 is moved to the position where the ejection failure detecting unit 16 (ink droplet receiving portions 31) is provided in the standby section (see FIG. 2) (FIG. 6, S110).

In particular, as shown in FIG. 4A, the carriage 4 is moved to a position above the ink droplet receiving portions 31 such that the position above the nozzle array (ink nozzles 11*a*) of the Bk ink is shifted from the position of the outlets 31*a* by a predetermined distance in the main scanning direction (major axis direction of the openings 31*b*) (FIG. 6, S110).

When the carriage 4 is moved to the position above the ink droplet receiving portions 31 (FIG. 6, S110), some ink droplets are ejected from each ink nozzle 11*a* of the Bk ink nozzle array (FIG. 6, S120). These ink droplets are ejected to the ink droplet receiving portions 31 flow to the outlets 31*a*, thereby forming menisci at the outlets 31*a*.

When the ink droplets are ejected from the ink nozzles 11*a* in step S120, the suction pump 34 generates a negative pressure (in this embodiment, 1 to 2 kPa) for detecting the menisci (FIG. 6, S130).

When the suction pump 34 generates the negative pressure for detecting the menisci in step S130, the presence of the menisci formed at the outlets 31*a* is determined on the basis of a pressure value in the ink collecting path 33 detected by the pressure sensor 35 (FIG. 6, S140).

In this embodiment, if the pressure value in the ink collecting path 33 is smaller than a predetermined threshold value, then it is determined that menisci are formed at all outlets 31*a* (FIG. 6, S140: YES). In contrast, if the pressure value in the ink collecting path 33 is larger than the threshold value, then it is determined that there is at least one outlet 31*a* without a meniscus (FIG. 6, S140: NO).

If it is determined that the menisci are formed at all outlets 31*a* (FIG. 6, S140: YES), it means that no ejection failure exhists in the nozzle array of the Bk ink. In other words, the ink droplets are normally ejected from the nozzle array of the Bk ink. This result (detection result) is then stored in a storage unit such as the RAM (FIG. 6, S150).

On the other hand, if it is determined that there is an outlet 31*a* without a meniscus (FIG. 6, S140: NO), it means that there is at least one ink nozzle 11*a* having an ejection failure in the nozzle array of the Bk ink. This result (detection result) is then stored in the storage unit such as the RAM (FIG. 6, S155).

After the result that an ejection failure is present or that no ejection failure is present is stored in the storage unit (S150 and S155), the suction pump 34 generates a negative pressure which is larger than the negative pressure generated in step S130 (negative pressure for detecting menisci), so as to collect (suck) any menisci formed at the outlets 31*a* to the waste ink tank 32 (FIG. 6, S150). In step S150, negative pressure of 30 to 50 kPa is generated.

After the negative pressure for collecting the menisci is generated (FIG. 6, S150), it is determined whether or not a nozzle array remains that has not been checked for ejection failure (FIG. 6, S170).

In the above description, since only the nozzle array for the Bk ink has been checked, the determination in step S170 is YES (FIG. 6, S170: YES), and the process returns to step S110 for the next nozzle array. In this case, the steps of S110 to S160 are repeated for the nozzle array of the C ink. Then the steps S110 to S160 are repeated for the Y ink, and finally for the nozzle array of the M ink.

After the steps S110 to S160 for the nozzle array of the M ink are completed, it is determined in step S170 that all the nozzle arrays have been checked for ejection failure (FIG. 6, S170: NO). The presence of a nozzle array (ink nozzles 11*a*) having an ejection failure is then determined based on the detection result stored in steps S150 and S155 (FIG. 6, S180).

If it is determined that no nozzle array has an ejection failure (FIG. 6, S180: NO), the process shown in FIG. 6 is ended. In contrast, if it is determined that any nozzle array has an ejection failure (FIG. 6, S180: YES), the above-described recovery operation is performed to remove any ink dried or any foreign substance trapped in any nozzle array (ink nozzles 11*a*) for which an ejection failure was detected (FIG. 6, S190). The process shown in FIG. 6 is then ended.

In this embodiment, if an ejection failure is detected in the nozzle array of the Bk ink, the recovery operation is executed for the nozzle array of the Bk ink. Similarly, if an ejection failure is detected in any of the nozzle arrays of the C ink, Y ink, and M ink, the recovery operation is executed respectively for those nozzle arrays for which ejection failure was detected.

In this embodiment, the ejection failure of the recording head 11 is detected by determining whether menisci are formed at the outlets 31*a* of the ink droplet receiving portions 31 after the ink droplets are ejected from the recording head 11 into the ink droplet receiving portions 31.

In particular, when the ink droplets are ejected from the recording head 11 to the ink droplet receiving portions 31, the ink droplets cause menisci to be formed at the outlets 31*a*. Therefore, when the menisci are formed at the outlets 31*a*, it can be assumed that an ejection failure of the recording head 11 has not occurred. In contrast, when a meniscus is not formed, it can be assumed that an ejection failure of the recording head 11 has occurred.

Therefore, with this embodiment, an ejection failure of the recording head 11 can be determined merely by determining whether menisci fail to be formed at the outlets 31*a*. This improves the reliability of the inkjet recording device 3.

Also, in this embodiment, the outlets 31*a* are closed by the menisci when the menisci are formed at the outlets 31*a*. Hence, if the suction pump 34 generates the appropriate negative pressure, then the pressure in the ink collecting path 33 is reduced. On the other hand, when a meniscus is not formed, the pressure in the ink collecting path 33 is not substantially reduced even though the suction pump 34 operates, because at least one of the outlets 31*a* is open.

Therefore, whether or not a meniscus fails to be formed can be determined merely by an appropriate reduction in the pressure in the ink collecting path 33.

Also, in this embodiment, since each of the ink droplet receiving portions 31 has the triangular cross section with one of the three vertices being directed downward (see FIG. 4), the ink droplets ejected to the ink droplet receiving portions 31 flow to the outlets 31*a*. This facilitates the movement of the ink droplets to the outlets 31*a*.

In addition, since each ink droplet receiving portion 31 is treated with the water repellant finish, the ink droplets do not stick to the ink droplet receiving portion 31, and thus easily flow to the outlet 31*a*.

As shown in FIG. 4A, when the ink droplets are ejected from the recording head 11 to the outlet 31*a*, the ink droplets are ejected to an inclined wall (guide wall) formed between the upper opening 31*b* and the outlet 31*a*. Accordingly, the ink droplets ejected to the ink droplet receiving portion 31 are prevented from passing through the outlet 31*a* to the ink collecting path 33.

When the ink droplets are ejected from the recording head 11 to each outlet 31*a*, multiple ink droplets are ejected from each nozzle. Accordingly, the multiple ink droplets combine to form a large ink droplet by the time they reach the outlet 31*a*, thereby reliably forming a meniscus at the outlet 31*a*.

In this embodiment, since the recording head 11 ejects the ink droplets to the ink droplet receiving portions 31 separately for each nozzle array, whether or not menisci are formed at the outlets 31*a* can be determined for each color (individual nozzle array).

Since only one nozzle array at a time is provided above the receiving portions 31, the number of ink droplet receiving portions 31 do not have to correspond to the total number of ink nozzles 11*a* in all of the nozzle arrays combined, thereby reducing the manufacturing cost.

In this embodiment, the ejection failure of the recording head 11 can be detected without using the electrodes as disclosed in the related art. Accordingly, this embodiment can be implemented at a lower cost than the invention disclosed in the related art.

Figure 7:
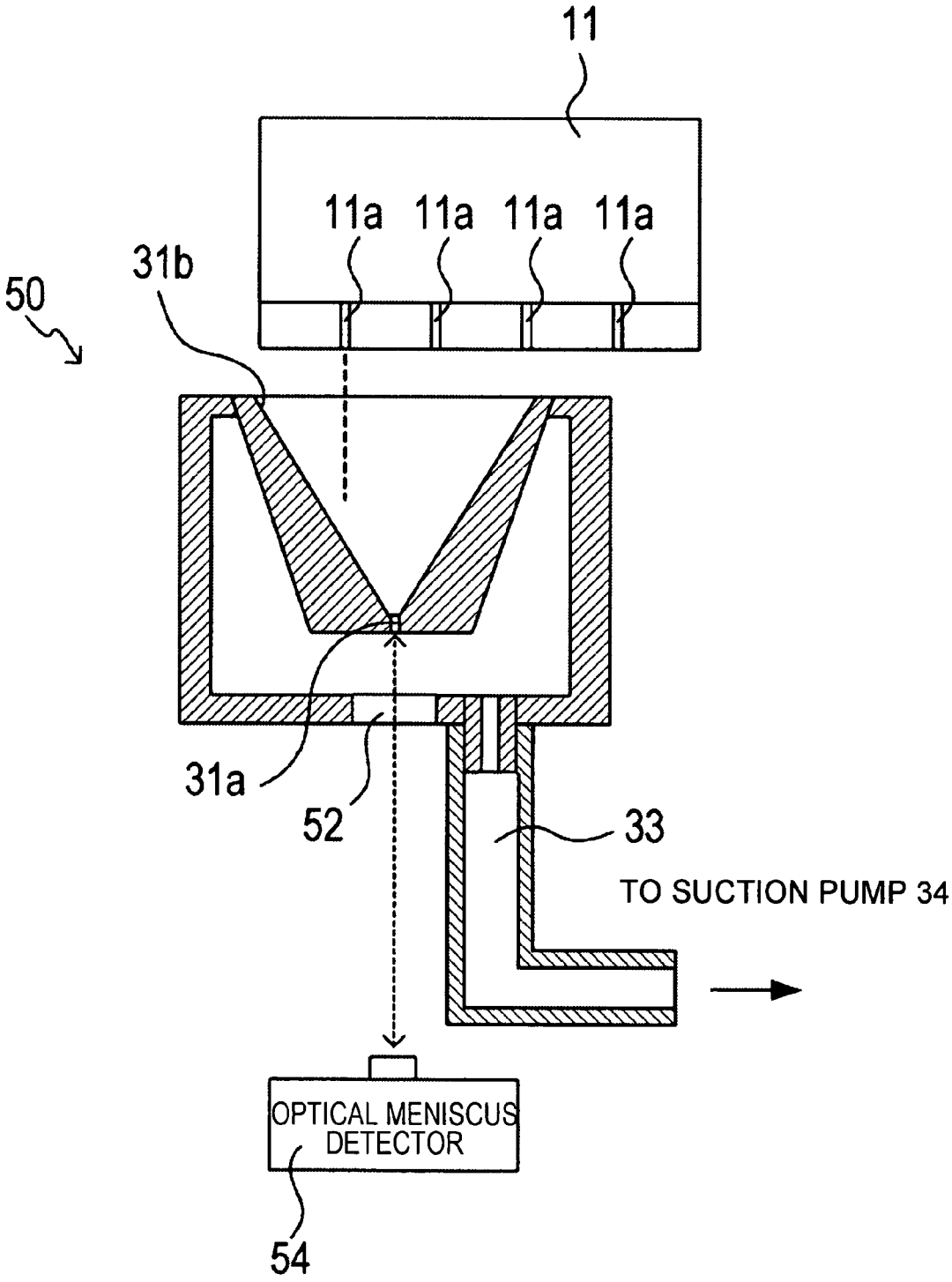
FIG. 7 is an explanatory illustration showing a configuration of an ejection failure detecting unit according to a second embodiment.

In the first embodiment, whether or not the menisci are formed is determined based on the pressure reduction in the ink collecting path 33. In a second embodiment, whether or not the menisci are formed is determined based on light which is reflected by the meniscus formed at the outlet 31*a*. FIG. 7 is an explanatory illustration showing a configuration of an ejection failure detecting unit 50 according to the second embodiment.

A light-transmittable member 52 made of glass, plastic, or the like, which transmits light, is disposed below the outlet 31*a*, in the ink collecting path 33. An optical meniscus detector 54, including a light emitter and a light receptor, is disposed below the light-transmittable member 52.

In this embodiment, when the ink droplet is ejected to the ink droplet receiving portion 31 in the ejection failure detecting process (see FIG. 6, S120), the light emitter of the optical meniscus detector 54 emits light, instead of the step of S130 of FIG. 6.

In this embodiment, the light emitted from the light emitter is reflected by the meniscus (ink droplet) formed at the outlet 31*a* and the light receptor of the optical meniscus detector 54 receives the light reflected by the meniscus.

Once the light is emitted from the light emitter of the optical meniscus detector 54, the presence of the meniscus (presence of an ejection failure) is determined based on whether or not the light is reflected back to the light receptor by the meniscus.

In particular, when a meniscus is formed at each outlet 31*a*, the light emitted from the light emitter is reflected by the meniscus back to the light receptor. On the other hand, when a meniscus is not formed, the light emitted from the light emitter passes the outlet 31*a*, and hence the light is not reflected back to the light receptor.

Therefore, with the use of the optical meniscus detector 54 of this embodiment, it can be determined whether the menisci are formed. Thus, this embodiment provides advantages similar to those of the first embodiment.

Although, in the first embodiment, the suction pump 34 generates a negative pressure in the ink collecting path 33, and the pressure sensor 35 detects the pressure value in the ink collecting path 33, the suction pump 34 may generates a positive pressure, instead.

In addition, while the ejection failure detecting unit 16 is disposed in the standby section in the first embodiment as shown in FIG. 2, it is not limited thereto. The ejection failure detecting unit 16 may alternatively be disposed in the gap adjusting section. In such a case, the suction pump 34 may generate negative pressure in the ink collecting path 33 as well as perform the recovery operation by sucking ink and the like that adheres to the ink nozzle 11*a* in a manner similar to the first embodiment. A plurality of suction pumps may also be used for these functions.

The inkjet recording device 3 may be an on-carriage type of device in which the ink tank is mounted on the carriage 4. Alternatively, the inkjet recording device 3 may be another type of device in which ink is supplied from an ink tank provided outside the carriage 4 to the recording head 11 through a tube.

Meanwhile, the proof stress of the meniscus may vary with the ambient temperature. In particular, the meniscus may become rigid and difficult to break when the ambient temperature is low. When the ambient temperature is high, the meniscus may become soft and easily broken.

Owing to this, a meniscus-determining threshold value for determining whether or not the meniscus is formed may be corrected based on information provided by the temperature sensor 73 (see FIG. 5).

For example, the meniscus-determining threshold value can be derived (corrected), by previously storing in the storage unit a meniscus-determining map that represents a relationship between the ambient temperature and the meniscus-determining threshold value. The meniscus-determining map may then be searched based on the information provided by the temperature sensor 73.

Accordingly, whether or not the meniscus is formed at the outlet 31*a* can be accurately determined.

While the opening shape of the ink droplet receiving portion 31 of the above-described embodiments is ellipsoidal, it is not limited thereto. The opening shape of the ink droplet receiving portion 31 may be another shape, such as rectangular or circular.

While the major and minor axes of the ink droplet receiving portion 31 of the above-described embodiments are reduced in length toward the outlet 31*a* from the upper opening 31*b*, it is not limited thereto Instead, only one of the major and minor axes may be reduced in length.

While the cross section of the ink droplet receiving portion 31 of the above-described embodiment is triangular as seen in either the sub-scanning direction or the main scanning direction (as shown in FIGS. 4A and 4B), it is not limited thereto. For example, only the cross section as seen in the sub-scanning direction may be triangular.

While the ink droplet receiving portion 31 has a funnel-like shape in the above-described embodiment, it is not limited thereto. In addition to the outlet 31*a*, the ink droplet receiving portion 31 is only required to have an inclined wall (guide wall) which is inclined with respect to an ink droplet ejecting direction (a vertical direction) so as to guide the ink droplet toward the outlet 31*a*.

Accordingly, in the above described embodiments, when the liquid droplet is ejected from the ejecting head to the liquid droplet receiving portion, a meniscus of the liquid droplet is formed at the outlet. When the meniscus is formed at the outlet, it is assumed that an ejection failure of the ejecting head has not occurred. In contrast, when the meniscus is not formed at the outlet, it is assumed that an ejection failure of the ejecting head has occurred.

Therefore, the ejection failure of the ejecting head can be accurately determined merely by determining the whether the meniscus is formed at the outlet, thereby improving the reliability of the liquid ejecting device.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. A printing device, comprising:

an ejecting head having an ejecting nozzle through which the ejecting head ejects ink in the form of an ink droplet;

an ink droplet receiving portion having an outlet that is open for forming a meniscus using the ink droplet ejected from the ejecting head, a meniscus determining unit for determining whether or not the meniscus is formed at the outlet;

a pump that generates a first pressure, which is either positive or negative, in a connection path that connects the pump to the outlet; and a pressure detecting unit for detecting a pressure in the connection path, wherein the meniscus determining unit determines whether or not the meniscus is formed based on a detection result of the pressure detecting unit.

2. A printing device according to claim 1;

wherein the pump generates a second pressure, which is negative, so as to remove the ink droplet ejected into the ink droplet receiving portion.

3. A printing device according to claim 1;

wherein the ink droplet receiving portion has a wall that extends from a top of the ink droplet receiving portion to the outlet; and wherein the wall is angled away from the outlet in a direction extending from the outlet to the top of the ink droplet receiving portion.

4. A printing device according to claim 1;

wherein the ink droplet receiving portion has a funnel-like shape, and is disposed below the ejecting head, and wherein the outlet is at a bottom of the ink droplet receiving portion.

5. A printing device according to claim 4;

wherein the ink droplet receiving portion is treated with a water repellant finish.

6. A printing device according to claim 4;

wherein the ejecting head ejects, through the ejecting nozzle, the ink droplet to the ink droplet receiving portion at a position that is deviated from the outlet; and wherein the position is deviated in a direction perpendicular to a vertical line passing through the outlet.

7. A printing device according to claim 1, further comprising:

a plurality of the ink droplet receiving portions arranged in an array;

wherein the ejecting head has a plurality of the ejecting nozzles, through each of which ink droplets are ejected, arranged in a plurality of ejecting nozzle arrays; and wherein the ejecting head ejects ink droplets toward the plurality of the ink droplet receiving portions through one of the ejecting nozzle arrays at a time.

8. A printing device according to claim 7;

wherein the array of ink droplet receiving portions is disposed at a position outside a recording section where the ejecting head ejects ink droplets onto a recording medium.

9. The printing device according to claim 7; wherein the connection path connects the pump to the outlets of the plurality of ink droplet receiving portions; and wherein the meniscus determining unit determines whether or not a meniscus is not formed in any of the outlets based on a detection result of the pressure detecting unit.

10. The printing device according to claim 1, further comprising:

a temperature sensor for detecting an ambient temperature;

wherein the meniscus determining unit determines whether or not the meniscus is formed based on a pressure detection result of the pressure detecting unit and a temperature detection result of the temperature sensor.

* * * * *